US006598287B1

(12) United States Patent
Carroll

(10) Patent No.: US 6,598,287 B1
(45) Date of Patent: Jul. 29, 2003

(54) APPARATUS AND METHOD FOR SIZING A GALVANIZED TUBE

(75) Inventor: Kevin Carroll, Long Beach, CA (US)

(73) Assignee: Western Tube & Conduit Corporation, Long Beach, CA (US)

( * ) Notice: Subject to any disclaimer, the term of this patent is extended or adjusted under 35 U.S.C. 154(b) by 0 days.

(21) Appl. No.: 10/056,704

(22) Filed: Jan. 24, 2002

(51) Int. Cl.[7] ..... B21B 1/46; B21B 13/22; B22D 11/126; B22D 11/128; B23P 17/00; B23P 25/00

(52) U.S. Cl. ..... 29/527.4; 29/527.2; 29/33 D; 29/335 T; 72/47; 72/51; 72/466.8

(58) Field of Search ..... 29/527.1, 527.2, 29/527.4, 33 D, 33 T; 72/47, 51, 466.8; 427/433

(56) References Cited

U.S. PATENT DOCUMENTS

| | | | |
|---|---|---|---|
| 2,588,439 A | | 3/1952 | Ward |
| 3,259,148 A | | 7/1966 | Krengel et al. |
| 3,559,280 A | | 2/1971 | Mailhiot et al. |
| 3,696,503 A | | 10/1972 | Krengel et al. |
| 4,358,887 A | | 11/1982 | Creps |
| 4,607,511 A | | 8/1986 | Shore |
| 4,621,399 A | | 11/1986 | Qureshi et al. |
| 4,768,280 A | | 9/1988 | Palmer et al. |
| 5,035,042 A | | 7/1991 | Maitra et al. |
| 5,050,418 A | | 9/1991 | Grotepass |
| 5,113,557 A | | 5/1992 | Maitra et al. |
| 5,305,624 A | | 4/1994 | Backhaus |
| 5,463,801 A | | 11/1995 | Kajiwara et al. |
| 5,732,874 A | | 3/1998 | Borzym et al. |
| 5,860,204 A | | 1/1999 | Krengel et al. |
| 6,042,891 A | * | 3/2000 | Crossingham et al. ..... 427/433 |

OTHER PUBLICATIONS

Patent Application Publication No. US2001/0008228 AI, Meier, et al; "Method for Producing a Molded Part and a Molded Part Produced According to Said Method"; Published Date: Jul. 19, 2001.

Patent Appl. Publication No. US2001/0015233 AI; Herman ,et al.; "Flexible Hose and Method for Manufacturing"; Publication Date: Aug. 23, 2001.

Patent Appl. Publication No. US2001/0018978 AI; Gordin, Myron K. et al.; "Ballast Box Pole Mounting System"; Publication Date: Sep. 6, 2001.

The Making , Shaping and Treating of Steel, United States Steel, 10$^{th}$ Edition, 1985, PP1065–66.*

* cited by examiner

*Primary Examiner*—P. W. Echols
(74) *Attorney, Agent, or Firm*—Fulbright & Jaworski, LLP

(57) ABSTRACT

A method and apparatus for sizing a galvanized tube, in which two sizing stations are used. A first sizing station having at least one sizing roll is used for sizing the tube prior to the galvanizing process. A second sizing station is then used, the station having at least one resilient sizing roll which is used for sizing the tube after the galvanizing process. By using a first sizing stand, which does most of the sizing work, the rolls in the second sizing stand need not pull the galvanized tubes with as much force. The advantage of the present invention is that cooler temperatures, faster mill speeds, and less cosmetic flaws in the finished galvanized product are seen, due to the lower force applied by the second sizing stand rolls to the galvanized product.

14 Claims, 1 Drawing Sheet

APPARATUS AND METHOD FOR SIZING A GALVANIZED TUBE

BACKGROUND OF THE INVENTION

1. Field of the Invention

The invention relates in general to a method and apparatus for sizing a galvanized tube. Specifically, two sizing stands are used. A first sizing stand with sizing rolls is used prior to the galvanizing process and a second sizing stand with resilient sizing rolls is used after the galvanizing process.

2. Description of the Related Art

There is a continuous need for galvanized tubes which can be shaped and sized yet still retain a durable surface. The U.S. patent to Creps, U.S. Pat. No. 4,358,887 disclosed the use of sizing rolls positioned upstream of a galvanizing process to create a tube having a round cross-section. Creps further disclosed steel pullout and straightening rolls positioned downstream from the galvanizing process. However, Creps' straightening rolls are not resilient sizing rolls and put a large force on the round tube, creating deformities. Creps also did not disclose a process for making shaped tubes, that require greater forces placed on them by the sizing rolls, in order to cause the tube to conform to the desired shape.

The U.S. patent to Kajiwara et al., U.S. Pat. No. 5,463,801, disclosed cold rolling mills disposed upstream from a metal plating bath and skin pass mill rolls disposed downstream from the bath. However, the Kajiwara rolls acted to roll the strip of metal prior to galvanization and did not act to size a metal tube. The U.S. patent to Palmer et al., U.S. Pat. No. 4,768,280 disclosed roll forming of metal articles before the galvanizing process and deforming rolls after the galvanizing process, but did not disclose sizing rolls used prior to and after the galvanizing process.

The U.S. patent to Krengel et al., U.S. Pat. No. 3,696,503 disclosed a method for continuously galvanizing strip steel in which a forming roll operation and a reforming roll operation are provided. However, the sizing rolls of Krengel et al. are not resilient rolls and the reforming rolls produce a flat strip and do not size a tube.

One problem associated with the steel sizing rolls of the prior art is that the rolls must exert enough pressure to pull the tube through and that pressure stretches the tube and shrinks the cross-section of the tube. Therefore, the original tube of the prior art must be made somewhat larger than the desired finished product, so that when the stretching and shrinking occurs, the proper cross-section is obtained. The method of the present invention has solved this problem and created several beneficial advantages. For example, the rolls in the first sizing stand of the present invention do most of the sizing work so that the rolls in the second sizing stand need not do as much work and need not pull the galvanized tubes with as much force.

The sizing rolls of the prior art processes generate non-uniform heat in such a way as to shear zinc from the galvanized tube. Also, previous galvanizing processes typically only apply a coating of about 12 microns of zinc in order to prevent cracking of the zinc coating upon sizing by the sizing rolls. An advantage of the present invention is that the second sizing stand comprises resilient sizing rolls, which provide less force on the galvanized tube and prevents cracking of the galvanized surface of the tube. Therefore, the second sizing stand rolls of the present invention perform less work on the galvanized tube which equates to: cooler temperatures; about 30–50% increased mill speeds; thicker galvanized coatings of up to about forty microns; and, fewer cosmetic flaws in the finished galvanized product.

Yet another advantage of the present invention is that prior art processes require the tubes to be uniformly cooled or at the same temperature throughout its length prior to going through the sizing rolls. The sizing rolls of the prior art then work the shaped tubes in a non-uniform manner, creating hot and cold bands along the length of the tube. The non-uniform bands cause straightening problems.

Since the second set of sizing rolls of the present invention grab the conduit with less force, the rolls will not work the hotter areas of the tube (specifically corners) differently than the cooler areas.

Another advantage of the present invention is that zinc from the galvanizing bath does not adhere to the plastic resilient sizing rolls. Therefore, the zinc cannot mark or dent the galvanized tube of the present invention. Also, unlike the sizing rolls of the prior art processes, the second sizing rolls of the present invention are not required to be in a precise progression in order to obtain the correct shape of the final galvanized product.

BRIEF SUMMARY OF THE INVENTION

The present invention discloses a method of sizing a galvanized tube comprising the steps of providing a first sizing station having at least one sizing roll, whereby the roll sizes the tube; galvanizing the tube; providing a second sizing station having at least one resilient sizing roll, whereby the resilient roll sizes the tube.

In another embodiment of the present invention a tube is made according to the process of providing a first sizing station having at least one sizing roll, whereby the roll sizes the tube, galvanizing the tube, and providing a second sizing station having at least one resilient sizing roll, whereby the resilient roll sizes the tube. The tube made by the present invention can be any shape of tubular cross section.

In yet a further embodiment of the present invention a tube sizing production line comprising: a supply station for continuously supplying a metal strip; means for continuously moving the strip along a path; a forming station for forming the metal strip into a tube having a predetermined shape; a welding station for joining the edges of the tube; a first sizing station having at least one set of rolls for sizing the tube; a galvanization station for galvanizing the tube; and a second sizing station having at least one set of resilient rolls for sizing the tube. (A set of rolls requires, at minimum, two opposing rolls, in order to "capture" (confine) the tube. Without opposing rolls, it is not possible to exert sufficient force on the tube to either "grab" or "reshape" it.)

These and other features, aspects, and advantages of the present invention will become better understood with regard to the following detailed description, appended claims, and accompanying drawings.

DETAILED DESCRIPTION OF THE INVENTION

The present invention provides an apparatus and method for sizing a galvanized tube. The tube can have either a round or square cross section. The products of the present invention, galvanized tubes, are applicable to building elements and members or articles of manufacture, in particular, electrical tubing, fence pipe, ornamental iron, and structural tubing.

Figure 1:
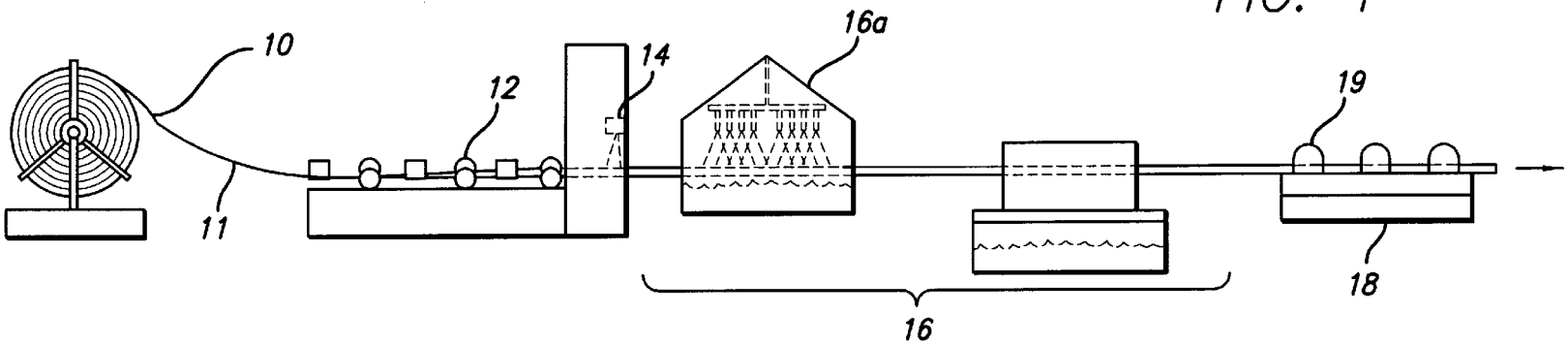
FIG. 1 is a schematic of the method and apparatus of the prior art showing the steps in the production of a galvanized product.

Referring now to the drawings, the prior art tube mill production line is illustrated in FIG. 1. Each of the stations is considered to be treating galvanized steel strip moving from left to right. Cold rolled steel 11 is taken off a payoff reel 10. The strip 11 may be appropriately treated so as to be ready for galvanizing and welding (not shown). The strip 11 passes through a tube forming station 12. The tube forming station 12 comprises a series of conventional forming rolls whereby the strip 11 is continuously deformed from its initial flat character to that of a rounded tube with the lateral edges of the strip 11 abutting to form a seam of the tube upon welding.

The tube form created by the tube forming station 12 advances to a welder 14 where the edges of the strip 11 are joined by welding, typically using an induction welder. After the welding is complete, typically the tube is passed through a scarfing and/or cleaning station (not shown) to remove any lubricants or oxides before the galvanization process 16. After the scarfing and/or cleaning station the tube is passed through a pickling station 16*a* for acid-treatment of the tube and rinsed to again clean it and prepare it for the galvanizing bath 16*b*. The tube then passes through a heating station (not shown) typically using induction heating where it is heated to about 700°–800° F. The heating station is located upstream of the galvanizing bath 16*b*.

Typically an inert atmosphere surrounds the tube (not shown) prior to entry into the galvanizing bath 16*b*. The heated tube then enters the galvanizing bath 16*b* where the tube is surrounded by molten zinc which wets and alloys with the surface of the metal tube 11, thereby coating the tube 11. The galvanized tube leaves the galvanizing bath 16*b* and passes through a cooling station (not shown), typically a water cooling bath, which lowers the temperature of the exterior surface of the tube prior to contact with a sizing station 18. The sizing station 18 comprises at least one set of steel sizing rolls 19 where the tube 11 is finally sized and straightened downstream of the galvanizing bath 16*b*. Not shown herein is the subsequent heating, cooling, and cutting steps prior to packaging the tube 11.

Figure 2:
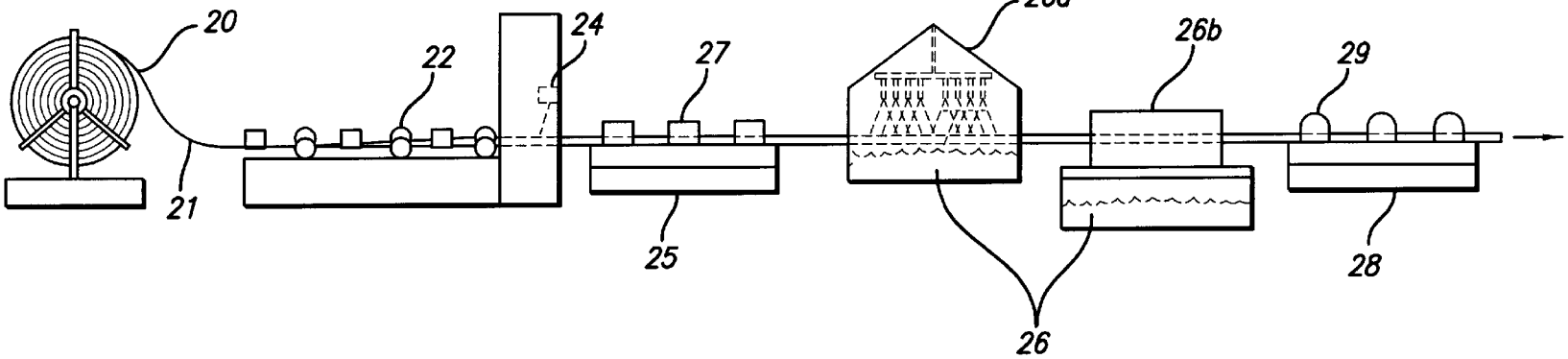
FIG. 2 is a schematic of the method and apparatus of the present invention showing the steps in the production of a galvanized product, specifically a first sizing stand used prior to the galvanizing process and a second sizing stand, having resilient rolls, used after the galvanizing process.

FIG. 2 illustrates the tube mill production line of the present invention. Again, each of the stations is considered to be treating a galvanized steel strip moving from left to right. Cold rolled steel 21 is taken off a payoff reel 20. The strip 21 may be appropriately treated so as to be ready for galvanizing and welding (not shown). The strip 21 passes through a tube forming station 22. The tube forming station 22 comprises a series of conventional forming rolls whereby the strip 21 is continuously deformed from its initial flat character to that of a rounded tube with the lateral edges of the strip 21 abutting to form a seam of the tube upon welding.

The tube formed from the strip 21 created by the tube forming station 22 advances to a welder 24 where the edges of the strip 21 are joined by welding, preferably using an induction welder. After the welding is complete, the tube 21 (previously strip 21) is passed through a first sizing station 25 whereby most of the force required to shape the tube 21 is performed. The first sizing station 25 comprises at least one set of opposing rolls 27 of brass, D2 steel or carbides that sizes the tube 21 to a predetermined size according to the customer's desire or trade standard. The sizing roll 27 is of conventional construction as embodied in commercial and well known equipment.

The tube 21 then passes through a scarfing and/or cleaning station (not shown) to remove any lubricants or oxides before the galvanization process 26. After the scarfing and/or cleaning station the tube is passed through a pickling station 26*a* for acid-treatment of the tube and rinsed to again clean it and prepare it for the galvanizing bath 26*b*. After the pickling station 26*a*, the tube then passes through a heating station (not shown) typically using induction heating where it is heated to about 700°–800° F. The heating station is located upstream of the galvanizing bath 26*b*.

An inert or non-oxidizing atmosphere (not shown), for example, nitrogen, surrounds the tube 21 prior to entry into the galvanizing bath 26*b*. The term "galvanizing" is used in the broadest sense and is not intended to be restricted to the use of pure zinc, as it well known to use a zinc/aluminum alloy in the galvanizing bath. The heated tube 21 then enters the galvanizing bath 26*b* where the tube is surrounded by molten zinc which wets and alloys with the surface of the metal tube 21, thereby coating the tube. The galvanized tube 21 leaves the galvanizing bath 26*b* and passes through a second sizing station 28. One of the advantages of the present invention is that a cooling station (not shown), typically a water cooling bath, does not have to be used since the galvanized tube 21 is not hot when it reaches the second sizing station 28. If a cooling station 28 is used, the temperature of the exterior surface of the galvanized tube 21 can be lowered prior to contact with the second sizing station 28.

The second sizing station 28 comprises at least one resilient sizing roll 29 where the galvanized tube 21 is finally sized and straightened. The first sizing roll 27 provides the greatest force on the pre-galvanized tube 21 in order to size and straighten the galvanized tube 21. Therefore, the second sizing roll 29 sizes the galvanized tube 21 with little force, causing little to no damage to the galvanized surface of the tube 21. The sizing roll 29 is of conventional size and cross-section and is preferably made resilient by use of a plastic, such as polypropylene. Nylon, polyesters, polyurethane, polyethylene, propylene, ethylene and copolymers thereof, or other thermoplastic resins, may also be readily used. Not shown herein is the subsequent heating, cooling, and cutting steps prior to packaging the galvanized tube 21. The finished galvanized tube made by the present invention has a thickness of about 0.040 to 0.160 wall.

The following references are incorporated herein by reference: U.S. patents to Creps, U.S. Pat. No. 4,358,887; U.S. patent to Kajiwara et al., U.S. Pat. No. 5,463,801; U.S. patent to Palmer et al., U.S. Pat. No. 4,768,280; and U.S. patent to Krengel et al., U.S. Pat. No. 3,696,503.

Although the foregoing invention has been described in some detail by way of illustration and example for purposes of clarity and understanding, it will be obvious that various modifications and changes, which are within the knowledge of those skilled in the art, are considered to fall within the scope of the appended claims.

What is claimed is:

1. A method of sizing a galvanized tube comprising the steps:

a) providing a first sizing station having at least one sizing roll, whereby the roll sizes the tube;

b) galvanizing the tube; and c) providing a second sizing station having at least one resilient sizing roll, whereby the resilient roll sizes the galvanized tube.

2. The method of claim 1, wherein the first sizing stand comprises a plurality of sizing rolls.

3. The method of claim 2, wherein the second sizing stand comprises a plurality of resilient sizing rolls.

4. The method of claim 1, wherein the second sizing stand comprises a plurality of resilient sizing rolls.

5. The method of claim 1, wherein the tube has a diameter of ½" to 5.0" and a wall thickness of about 0.040" to 0.160".

6. The method of claim 1, wherein the tube is square shaped.

7. The method of claim 1, wherein the tube is round shaped.

8. A tube sizing production line comprising:

a) a supply station for continuously supplying a metal strip;

b) a forming station for forming said metal strip into a tube having a predetermined shape;

c) a welding station for joining the edges of the tube;

d) a first sizing station having at least one roll for sizing the tube e) a galvanization station for galvanizing the tube; and f) a second sizing station having at least one resilient roll for sizing the galvanized tube.

9. The tube sizing production line of claim 8, wherein the first sizing stand comprises a plurality of sizing rolls.

10. The tube sizing production line of claim 9, wherein the second sizing stand comprises a plurality of resilient sizing rolls.

11. The tube sizing production line of claim 8, wherein the second sizing stand comprises a plurality of resilient sizing rolls.

12. The tube sizing production line of claim 8, wherein the tube has a diameter of ½" to 5.0" and a wall thickness of about 0.040" to 0.160".

13. The tube sizing production line of claim 8, wherein the tube is square shaped.

14. The tube sizing production line of claim 8, wherein the tube is round shaped.

* * * * *